US006494512B1

(12) United States Patent
Cada et al.

(10) Patent No.: US 6,494,512 B1
(45) Date of Patent: Dec. 17, 2002

(54) ZIPPER PULLING DEVICE

(76) Inventors: Antony D. Cada, 5759 Firenza Dr., Houston, TX (US) 77035; James M. Dillard, 510 Bay Colony, LaPorte, TX (US) 77571

( * ) Notice: Subject to any disclaimer, the term of this patent is extended or adjusted under 35 U.S.C. 154(b) by 0 days.

(21) Appl. No.: 09/614,111

(22) Filed: Jul. 12, 2000

(51) Int. Cl.[7] ..... A44B 19/00
(52) U.S. Cl. ..... 294/3.6; 24/429
(58) Field of Search ..... 24/376, 429; 294/3.6; 206/810; 7/118; 223/115, 116, 119, DIG. 4; 403/93, 94

(56) References Cited

U.S. PATENT DOCUMENTS

| | | | | | |
|---|---|---|---|---|---|
| 49,194 | A | * | 6/1865 | Mayland | 7/118 |
| 254,404 | A | * | 2/1882 | Story | 7/118 X |
| 541,793 | A | * | 6/1895 | Schenck | 7/118 |
| 603,847 | A | * | 5/1898 | Harvey | 7/118 X |
| 631,872 | A | * | 8/1899 | Johnston | 7/118 X |
| 1,318,515 | A | * | 10/1919 | Voos | 7/118 |
| 1,561,262 | A | * | 11/1925 | Martin | 7/118 |
| 1,889,286 | A | * | 11/1932 | Kaipust | 403/94 |
| 2,089,536 | A | * | 8/1937 | Champlin et al. | 7/118 X |
| 3,017,680 | A | * | 1/1962 | Duncan | 294/3.6 |
| 3,284,865 | A | * | 11/1966 | Burnham | 294/3.6 |
| 3,310,853 | A | * | 3/1967 | Winn | 294/3.6 |
| D207,628 | S | * | 5/1967 | Zern | D11/221 |
| 3,348,869 | A | * | 10/1967 | Zern | 294/3.6 |
| 3,348,870 | A | * | 10/1967 | Zern | 294/3.6 |
| 3,522,964 | A | * | 8/1970 | Posavec | 294/3.6 |
| 3,704,491 | A | * | 12/1972 | Burgess | 294/3.6 |
| 4,067,487 | A | * | 1/1978 | Carr et al. | 294/3.6 X |
| 4,193,172 | A | | 3/1980 | Kanzaka | |
| 4,368,562 | A | | 1/1983 | Minami | |
| 4,389,758 | A | | 6/1983 | Akashi | |
| 4,823,447 | A | | 4/1989 | Akashi | |
| 4,873,750 | A | | 10/1989 | Tracy | |
| 4,918,794 | A | | 4/1990 | Harvey et al. | |
| D319,804 | S | | 9/1991 | Johnson et al. | |
| D320,367 | S | | 10/1991 | Kalbach | |
| 5,100,191 | A | | 3/1992 | Detrick et al. | |
| 5,442,529 | A | * | 8/1995 | Hoover | 7/118 X |
| 5,537,750 | A | * | 7/1996 | Seber et al. | 7/118 X |
| 5,542,139 | A | * | 8/1996 | Boivin | 7/118 |
| D381,487 | S | * | 7/1997 | Sweeney | D2/641 |
| 5,711,194 | A | * | 1/1998 | Anderson et al. | 7/118 X |
| 5,930,874 | A | | 8/1999 | Yamazaki et al. | |

FOREIGN PATENT DOCUMENTS

| | | | | |
|---|---|---|---|---|
| GB | 2 190 706 A | * | 11/1987 | 294/3.6 |

* cited by examiner

*Primary Examiner*—Robert J. Sandy
*Assistant Examiner*—Ruth C. Rodriguez
(74) *Attorney, Agent, or Firm*—Dale J. Ream

(57) ABSTRACT

A zipper pulling device for manipulating a slide fastener having a slider body with a pull tab connected thereto, the pull tab defining a hole therein, the zipper pulling device comprising a handle member having a hook member pivotally coupled thereto. The handle member includes front and rear ends with a bottom wall and upstanding side walls extending therebetween. The side walls define an open channel extending from the front end toward the rear end of the handle member. The hook member is pivotally coupled to a shaft that extends across the channel and presents a J-shaped configuration having a free end dimensioned so as to be received through the hole of the pull tab of a slide fastener. The hook member is pivotally movable between a first storage position in which the free end is received by a recess formed in the bottom wall of the channel and a second use position wherein the free end extends from the front end of the handle member. Grooves are provided in the channel walls for seating the hook member in either the first or second position.

4 Claims, 4 Drawing Sheets

ZIPPER PULLING DEVICE

BACKGROUND OF THE INVENTION

This invention relates generally to a device for operating a slide fastener or zipper and, more particularly, to a zipper pulling device having a hook member which may be selectively pivoted between storage and use positions relative to a handle member.

Slide fasteners such as zippers are commonly encountered on pants, jeans, garment bags, luggage, and other types of garments and containers. A typical problem with manipulating such fasteners is that when the two sides of complementary fasteners are spread too far apart, a great pulling effort upon the fastener pull tab is required in order to join the fasteners together. It is difficult for a person to maintain sufficient grip upon the pull tab to successfully join the complementary fasteners together, especially for persons having arthritis or other disorders which reduce dexterity. Another problem occurs when a pull tab becomes lodged behind a fold of material that is part of the complementary fastener arrangement.

Various devices have been proposed in the prior art for attachment to the pull tab of a slider fastener to assist in manipulation thereof. Although assumably effective for their intended purposes, existing devices are not convenient for unobtrusive transport or storage.

Therefore, it is desirable to have a zipper pulling device which is compact and may be conveniently attached to a key ring. Further, it is desirable to have a zipper pulling device in which the hook member is pivotal between storage and use positions such that the hook member is unobtrusive and will not inadvertently become snagged.

SUMMARY OF THE INVENTION

Therefore, a zipper pulling device according to a preferred embodiment of the present invention includes a handle member having front and rear ends with a bottom wall and opposing side walls extending between the front and rear ends. Frontward portions of the side and bottom walls are formed so as to define a narrow channel having an open top. A J-shaped hook member is pivotally mounted within the channel and is movable between first and second positions. The hook member includes a first end pivotally coupled to a shaft that extends across the channel and a free end that is dimensioned so as to be selectively received through the hole of a pull tab portion of a slide fastener. The first position is for storing the hook member within the channel and the bottom wall forms a recess for receiving the free end of the hook member at the first position. In the second position, also referred to as the use position, the free end of the hook member is pivotally rotated to extend from the front end of the handle member. Grooves formed in the side walls within the channel seat the hook member in either the first or second position, as desired.

Therefore, a general object of this invention is to provide zipper pulling device to assist people in manipulating a zipper against resistance to such manipulation.

Another object of this invention is to provide a device, as aforesaid, which folds into a compact, unobtrusive structure for convenient storage or transport.

Still another object of this invention is to provide a device, as aforesaid, which does not inadvertently snag clothing when not in use.

Yet another object of this invention is to provide a device, as aforesaid, which aids a person with reduced dexterity to manipulate a zipper.

A further object of this invention is to provide a device, as aforesaid, which can be carried on a conventional key ring so as to be readily available when needed.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENTS

The preferred embodiment of the zipper pulling device 10 according to the present invention will now be described with reference to FIGS. 1*a* through 4 of the accompanying drawings.

Figure 1A:
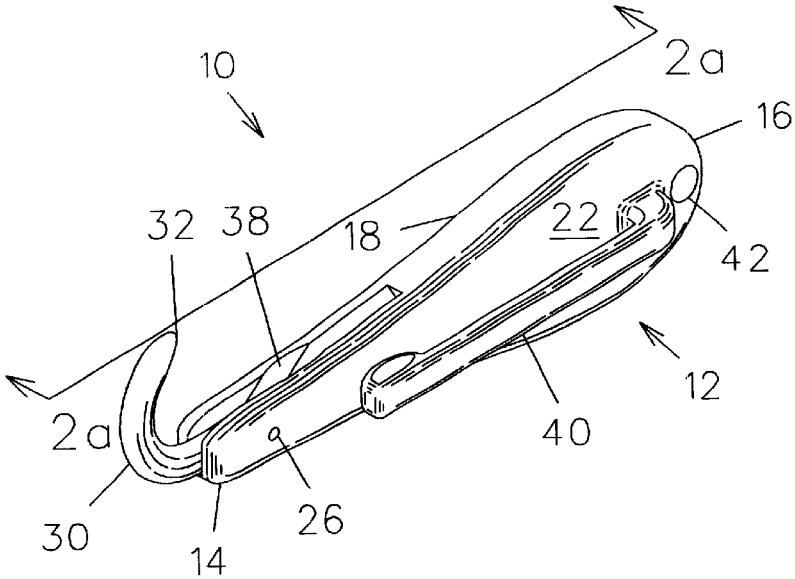
FIG. 1*a* is a perspective view of a zipper pulling device according to the present invention in a use configuration.
Figure 3A:
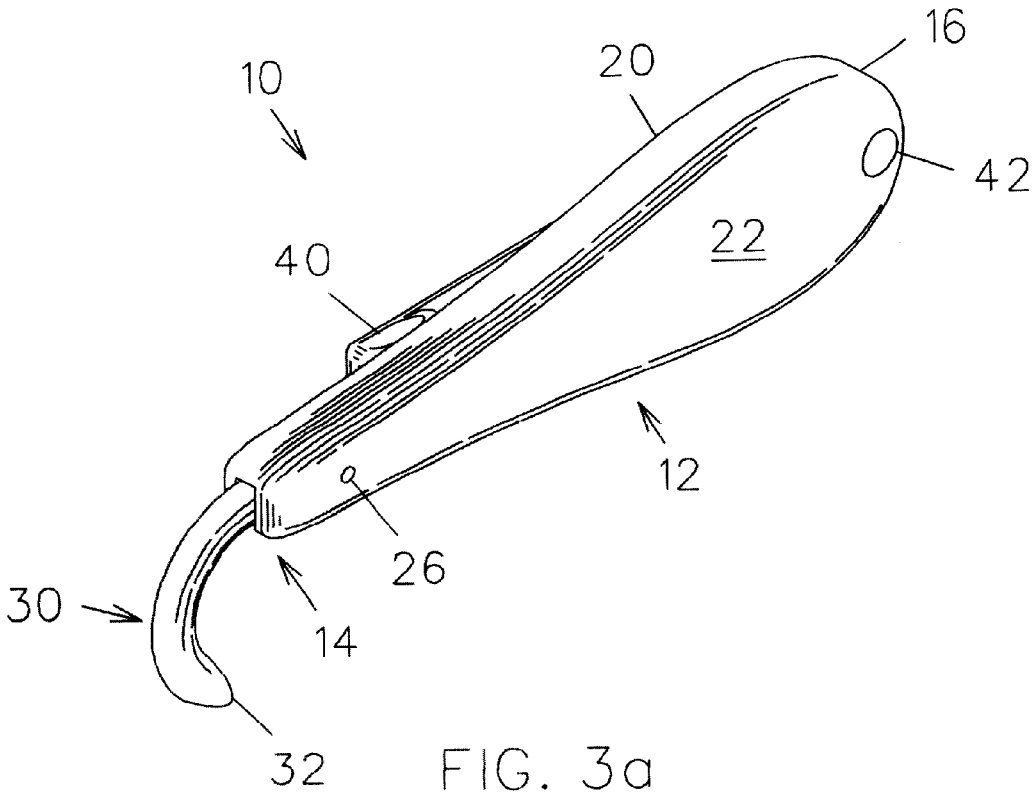
FIG. 3*a* is a perspective view of the device as in FIG. 1*a* in an inverted position.
Figure 3B:
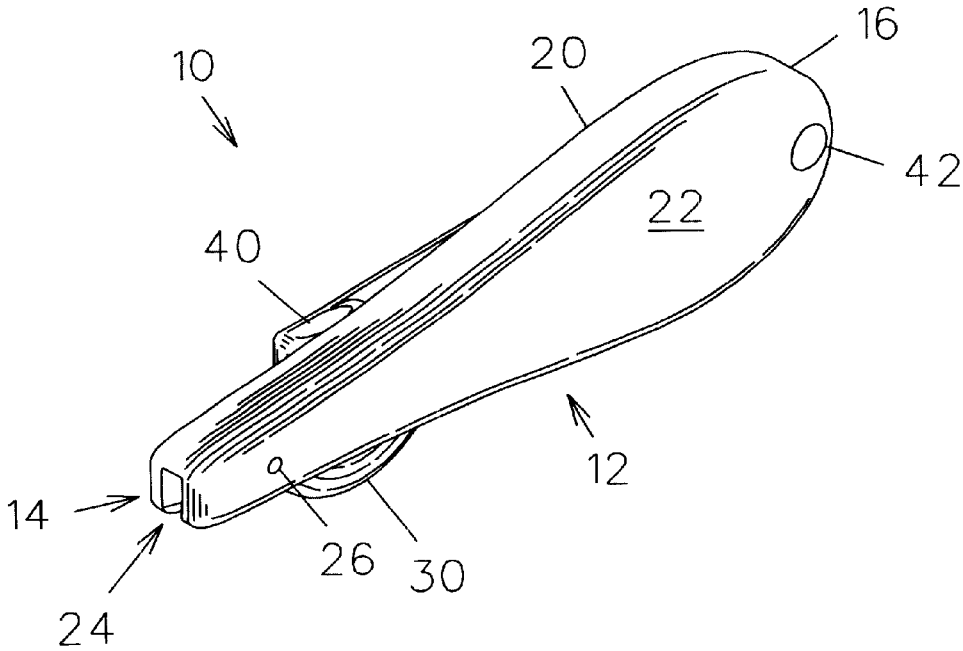
FIG. 3*b* is a perspective view of the device as in FIG. 1*b* in an inverted position.
Figure 4:
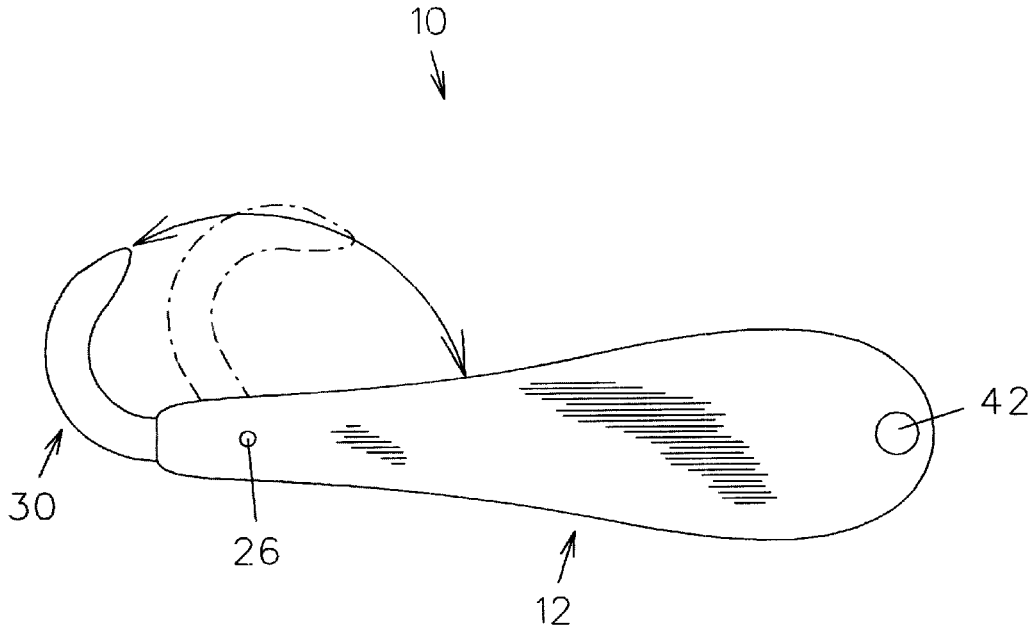
FIG. 4 is a side view of the device showing movement of the hook member between FIGS. 1*a* and 1*b* configurations.

The zipper pulling device 10 includes a handle member 12 constructed of a rigid plastic material although the device could also be suitably constructed of a metal such as aluminum. The handle member 12 includes opposed front 14 and rear 16 ends having top 18 and bottom 20 walls extending longitudinally therebetween with spaced apart side walls 22 extending between the top 18 and bottom 20 walls (FIGS. 1*a* and 3*a*). The circumference of the handle member 12 increases from the front end 14 to the rear end 16 to form a teardrop configuration (FIG. 1*a*).

Frontward portions of the side 22 and bottom 20 walls form a narrow channel 24 having an open top. The channel 24 extends from the front end 14 toward the rear end 16, preferably less than half the distance between the front 14 and rear 16 ends (FIG. 1*a*). A shaft 26 extends between interior surfaces of the side walls within the channel 24, the shaft 26 being normal to an imaginary longitudinal axis extending the length of the handle member 12.

Figure 2A:
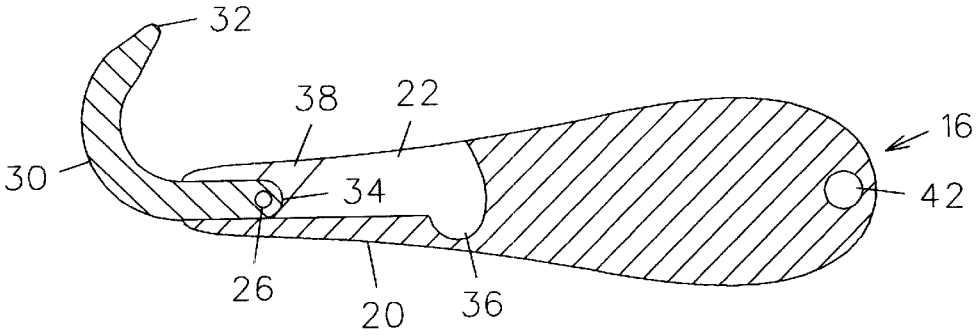
FIG. 2*a* is a sectional view of the device taken along line 2*a*—2*a* of FIG. 1*a;*
Figure 2B:
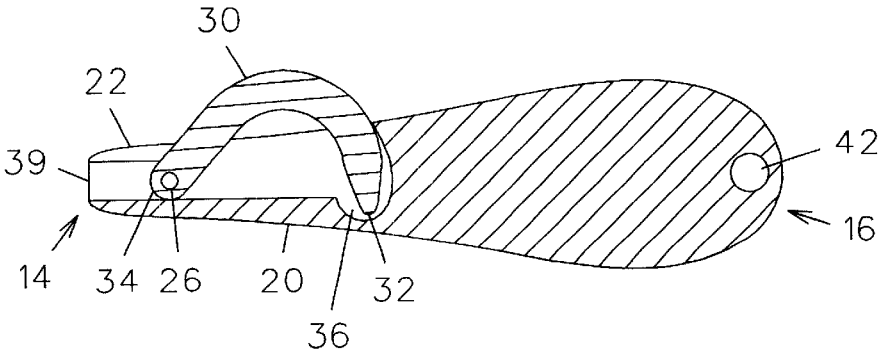
FIG. 2*b* is a sectional view of the device taken along line 2*b*—2*b* of FIG. 2*b;*

The zipper pulling device 10 includes a J-shaped hook member 30 having a pointed free end 32 and another end 34 pivotally coupled to the shaft 26 (FIGS. 2*a* and 2*b*). Therefore, the hook member 30 is pivotally movable between a first storage position in which the free end 32 is selectively positioned within a recess 36 defined by the bottom wall 20 of the channel 24 at the rearward end thereof (FIG. 2*b*) and a second use position in which the arcuate portion of the hook member 30 extends from the front end 14 of the handle member 12 (FIG. 2*a*). The free end 32 is configured to be received through the hole of a pull tab that is coupled to a conventional slide fastener or zipper. It is appreciated that the channel 24 includes a width dimension slightly smaller than the width of the hook member 30 such that the hook member 30 is held in a user-selected position according to a friction fit relationship.

As shown in FIGS. 2*a* and 2*b*, rearwardly diagonal grooves 38 are defined by the interior surfaces of the channel side walls 22 at a position spaced from the front end 14 such that a straight portion of the J-shaped hook member 30 may be seated therein when at the first storage position. Similarly, horizontal or longitudinally extending grooves 39 are defined by the interior surfaces of the channel side walls 22 and extend rearwardly from the front end 14 to a point adjacent the shaft 26 such that the straight portion of the hook member 30 may be seated therein at the second use position.

Figure 1B:
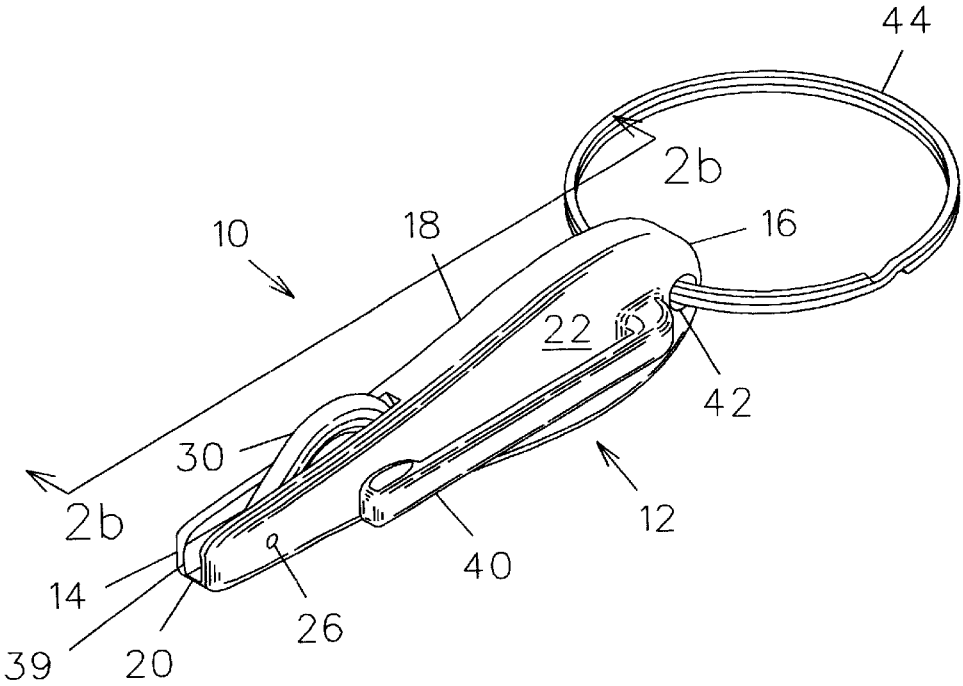
FIG. 1*b* is a perspective view of the zipper pulling device as in FIG. 1 in a storage configuration.

A clip 40 is attached to a side wall 22 adjacent the rear end 16 thereof and extends toward the front end 14 for removably attaching the device 10 to a person's shirt pocket, belt, or other support (FIG. 1*a*). The handle member 12 further defines a bore 42 or generally circular hole through the side walls 22 adjacent the rear end 16 thereof, the bore 42 having a diameter suitable for receiving the rings of a conventional key ring 44 therethrough (FIG. 1*b*).

In use, the zipper pulling device 10 may be removably coupled to a key ring 44 by inserting the key ring 44 through the handle member bore 42. Alternatively, the device 10 may be removably attached to a user's shirt pocket, belt, pants pockets, etc. with the clip 40. When the device 10 is merely being routinely transported, the hook member 30 may be pivoted to the storage position (FIG. 1*b*) wherein the pointed free end 32 of the hook member 30 is received in the channel recess 36 and will not become snagged on the user's clothing. When the zipper pulling device 10 is needed to manipulate a zipper, the hook member 30 is pivoted into a use position (FIG. 1*a*) wherein the free end 32 extends from the front end 14 of the handle member 12. The grooves 38, 39 formed in the interior surfaces of the side walls 22 within the channel 24 enhance the friction fit relationship which holds the hook member 30 in a desired position. The free end 32 is configured so as to be easily received through the hole of a pull tab element of a zipper to enable manipulation thereof. Following use, the hook member 30 may again be pivoted into a storage position.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A zipper pulling device for manipulating a slide fastener having a slider body with a pull tab connected to said slider body, said pull tab defining a hole therein, said zipper pulling device comprising:

a handle member having front and rear ends with a top wall and a bottom wall extending between said front and rear ends and having a pair of side walls extending between said top and bottom walls, said top wall and said side walls defining a channel extending from said front end to a point intermediate said front and rear ends;

a hook member having a free end dimensioned to be received by the hole of said pull tab, said hook member being pivotally coupled to a shaft extending across said channel between said side walls, said hook member being selectively movable between a first configuration in which said free end is contained within said channel and a second configuration in which said free end extends from said front end of said handle member;

wherein said channel includes a width dimension slightly smaller than a width dimension of said hook member such that said hook member is held in said first or second configuration in a friction fit relationship;

wherein at least one of said side walls includes a rearwardly directed diagonal groove in said channel spaced from said front end adapted to seat said hook member therein at said first configuration;

wherein at least one of said side walls includes a longitudinally extending groove adjacent said front end adapted to seat said book member therein at said second configuration; and wherein said bottom wall defines a recess in said channel having a configuration complementary to a configuration of said free end of said hook member and situated between said side walls at said point intermediate said front and rear ends, said recess adapted to receive said free end of said hook member at said first configuration.

2. A zipper pulling device as in claim 1 further comprising a clip attached to said side wall of said handle member adjacent said rear end and extending toward said front end, said clip adapted to removably couple said handle member to a selected support.

3. A zipper pulling device as in claim 1 wherein said handle member defines a bore adjacent said rear end adapted to receive a key ring therethrough.

4. A zipper pulling device as in claim 1 wherein said handle member includes a teardrop configuration wherein a circumference dimension of said handle member is gradually increased between said front and rear ends.

* * * * *